US009355794B2

(12) United States Patent
Chu

(10) Patent No.: US 9,355,794 B2
(45) Date of Patent: May 31, 2016

(54) PUSH-TYPE SWITCH WITH DISPLAY

(71) Applicant: Ching-Hsiung Chu, Taipei (TW)

(72) Inventor: Ching-Hsiung Chu, Taipei (TW)

( * ) Notice: Subject to any disclaimer, the term of this patent is extended or adjusted under 35 U.S.C. 154(b) by 55 days.

(21) Appl. No.: 14/564,095

(22) Filed: Dec. 9, 2014

(65) Prior Publication Data

US 2016/0064163 A1 Mar. 3, 2016

(30) Foreign Application Priority Data

Aug. 28, 2014 (TW) ..... 103129660 A

(51) Int. Cl.
*H01H 9/00* (2006.01)
*H01H 13/02* (2006.01)
*H01H 13/14* (2006.01)

(52) U.S. Cl.
CPC ..... *H01H 13/023* (2013.01); *H01H 13/14* (2013.01); *H01H 2219/037* (2013.01)

(58) Field of Classification Search
CPC ..... H01H 13/83; H01H 9/16; H01H 9/161; H01H 9/18; H01H 9/181; H01H 9/182; H01H 2219/014; H01H 2219/016; H01H 2219/036; H01H 2219/037
USPC ..... 200/314, 310, 312, 315, 341, 345, 520; 362/23.01, 23.04, 23.05
See application file for complete search history.

(56) References Cited

U.S. PATENT DOCUMENTS 4,990,730 A * 2/1991 Shinohara ..... H01H 1/5805 200/314
5,278,362 A * 1/1994 Ohashi ..... H01H 9/181 200/314
7,804,037 B2 * 9/2010 Cove ..... H01H 9/181 200/314
8,304,673 B2 * 11/2012 Sun ..... H01H 13/83 200/314

* cited by examiner

*Primary Examiner* — Vanessa Girardi

(57) ABSTRACT

A push-type switch includes a cap lid made of a light permeable material, a shielding board, a holding board, a movable seat, a display module disposed between the cap lid and the movable seat, a lighting element disposed in the movable seat, a conducting unit having a conducting element being flexible and a plurality of conducting terminals, and a housing. When the cap lid is being pushed downward, the movable seat moves concurrently to depress the conducting element, whereby the conducting element being deformed to electrically contact the conducting terminals so as to switch on and off the push-type switch, and the lighting element and the display module being capable of emitting light and displaying images respectively according to the state of switch and electrical signals transmitted from a printed circuit board to the lighting element and the display module.

10 Claims, 4 Drawing Sheets

PUSH-TYPE SWITCH WITH DISPLAY

BACKGROUND OF THE INVENTION

1. Field of the Invention

The present invention relates to a switch structure, and particularly to a push-type switch which has a reinforced structure and is capable of displaying images thereon and indicating a state of switch.

2. Related Art

As is well known, electrical switches vary in size and specifications, and are widely used in most electrical products or appliances. General precision equipments, small equipments or electric appliances usually use an electronic switch, and most electronic switches are smart switches, micro switches and touch switches. Since these types of switches have a light, thin, short and compact design, therefore they can be applied to electronic devices and instruments with a very limited space or having small or micro switches, such as the 3C electronic products or microcomputers.

Traditional switches, including push-type switches, have been improved to provide not only the functions of switch on and switch off, but also a lighting element therein for indicating controlling signals by brightness or colors of light emitted. Taking the push-type switch for example, as the push-type switch is being pushed, the lighting element inside emits light for indicating that the switch is being switched on. Likewise, as the switch is being pushed again to switch off, the lighting element does not emit light. Furthermore, a surface of a traditional push-type switch is usually printed with certain patterns or marks for representing functions of a product that is controlled by the switch. However, such patterns or marks being printed tend to fade away or even peel because of repeatedly touch and push. On the other hand, a traditional switch includes a cap, a movable object, a lighting element provided in the movable object, and a housing. The movable object is depressible to move in the housing. Therefore, two opposite sides of the housing are to be breached to allow electrical terminals of the lighting element inside the movable object to extend out for electrical connection. As a result, structural strength of the housings is significantly reduced, whereby the housings easily to deform and seriously affect the use of the switch.

SUMMARY OF THE INVENTION

Accordingly, an object of the present invention is to provide a push-type switch having a reinforced structure and a function of indicating a state of switch by light emission therein.

Another object of the present invention is to provide a push-type switch being capable of displaying dynamitic or static images for indicating functions of an electrical product being applied.

To achieve the above-mentioned objects, the push-type switch of the present invention comprises a movable seat comprising two opposite interfering walls, and two opposite positioning walls for interconnecting the interfering walls, each of the interfering walls having an engaging rib formed on an outer surface thereof. An accommodating space is defined by the interfering walls and the positioning walls. A cap lid covers a top of the movable seat, and comprises a first display portion and a second display portion made of a light permeable material. A display module is disposed between the cap lid and the movable seat and is electrically connected to a printed circuit board, the display module being capable of displaying dynamic images or static images which are being seen from the first display portion of the cap lid. A lighting element is fixedly disposed in the accommodating space of the movable seat and electrically connected to the printed circuit board, the lighting element being capable of emitting light which is permeable to the second display portion of the cap lid for at least indicating a state of switching. A housing has a storing chamber formed therein which is open upward, and two engaging slots respectively formed on two opposite sides of the housing. The engaging rid is slidably engageable with the engaging slots so as to limit a course of travelling of the movable seat. A conducting unit is disposed in the storing chamber and comprises a conducting element being flexible and a plurality of conducting terminals, one end of each of the plurality of conducting terminals secured in the storing chamber and another end thereof extending out of the housing to electrically connect the printed circuited board.

With the above-mentioned structure, the cap lid is being pushed downward, the movable seat moves concurrently to depress the conducting element, whereby the conducting element being deformed to electrically contact the conducting terminals so as to switch on and off the push-type switch, and the lighting element and the display module being capable of emitting light and displaying images respectively according to the state of switching of the push-type switch and electrical signals transmitted from the printed circuit board to the lighting element and the display module.

In one aspect of the present invention, the display module comprises a base portion, at least an organic light emitting diode (OLED), a flexible cable, and a connecting board connecting a terminal group and a connector, the base portion disposed on a top of the movable seat, the at least an OLED disposed on the base portion and located under and facing the first display portion, the connecting board and the connector configured in the accommodating space of the movable seat, where the terminal group extends out of the housing to be connected to the printed circuit board, and one end of the flexible cable is connected to the base portion and another end thereof extends into the accommodating space to connect the connector.

In another aspect of the present invention, the push-type switch further comprises a shielding board disposed under the cap lid and above the display module, the shielding board having a hollow portion and a shielding portion surrounding the hollow portion for shielding the base portion of the display module, with the hollow portion correspondingly fitted to the OLED. The cap lid further comprises a non-display portion corresponding to the shielding portion of the shielding board.

Still in one aspect of the present invention, the push-type switch further comprises a holding board disposed on the top of the movable seat, the holding board having a holding portion, a light-permeable portion, and a reinforcing pillar formed under the holding portion, the holding portion configured to hold the base portion of the display module, the light-permeable portion being permeable to light emitted from the lighting element, and the reinforcing pillar made of a light-permeable material and embedded into the accommodating space for reinforcing structural strength of the movable seat.

The push-type switch of the present invention is to utilize the light emitted by the lighting element and the dynamic or static images displayed by the display module, in accordance with electrical signals being received, for simultaneously showing a switching state and functions of applied products to be controlled by the push-type switch, so as to effectively overcome the problem that traditional switches are not capable of indicating a switch state or functions to be controlled on a button thereof. Furthermore, the configuration of the OLED greatly reduces an overall size of the push-type switch because of features of self light-emission and wide viewing angles of the OLED. Moreover, the holding board effectively improves the structural strength of the movable seat so as to address the problem that traditional switches are weak in structural strength.

DESCRIPTION OF THE PREFERRED EMBODIMENTS

Figure 1:
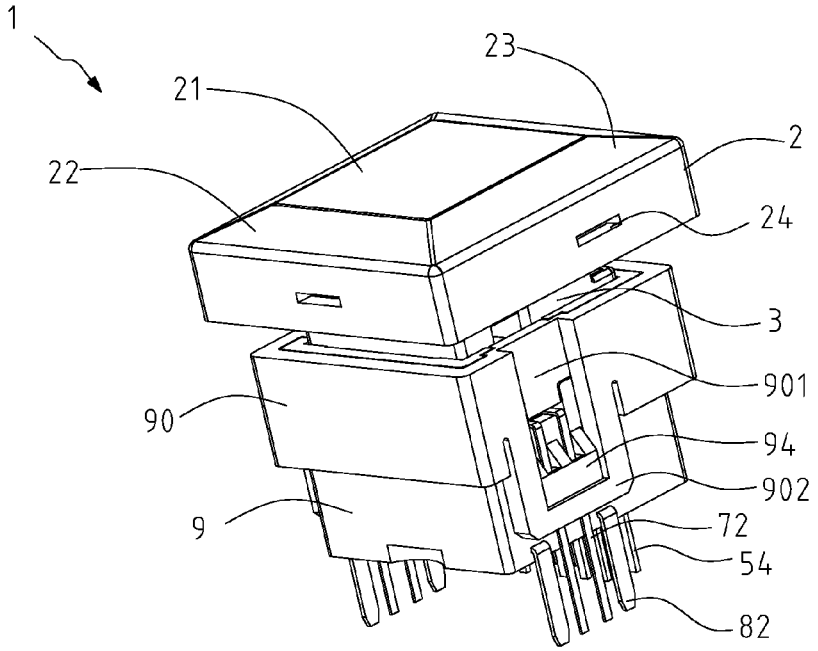
FIG. 1 is a front, top perspective assembly view of a push-type switch of the present invention.

Referring to FIGS. 1 to 4 illustrating a preferable embodiment of a push-type switch 1 of the present invention, the push-type switch 1 comprises a cap lid 2, a movable seat 3, a shielding board 4, a display module 5, a holding board 6, a lighting element 7, a conducting unit 8 and a housing 9. The cap lid 2 is made of a light-permeable material, and covers a top of the movable seat 3. The cap lid 2 comprises a first display portion 21 which is located at a middle portion of the cap lid 2 and is surrounded with a second display portion 22 and a non-display portion 23. In this embodiment, the cap lid 2 has a rectangular shape, wherein the second display portion 22 located at a side of the first display portion 21, while the non-display portion 23 surrounds other sides of the first display portion 21. Furthermore, peripheries of the second display portion 22 and the non-display portion 23 extend and bend downward where multiple trenches 24 are formed thereon.

The movable seat 3 comprises two opposite interfering walls 31, and two opposite positioning walls 32 for interconnecting the interfering walls 31. Each of the interfering walls 31 has an engaging rib 311 formed on an outer surface thereof, and an accommodating space 30 is defined by the interfering walls 31 and the positioning walls 32. The movable seat 3 is further provided with a partition 301 traversally connecting the positioning walls 32 to divide the accommodating space 30. Each of the positioning walls 32 is provided with a guiding slot 321 penetrating a top of the positioning wall 32. Particularly, tops of the interfering walls 31 and the positioning walls 32 further extend horizontally to form platforms 35. The platforms 35 are provided with plural ridges 34 for being engaged with the multiple trenches 24 of the cap lid 2.

Figure 3:
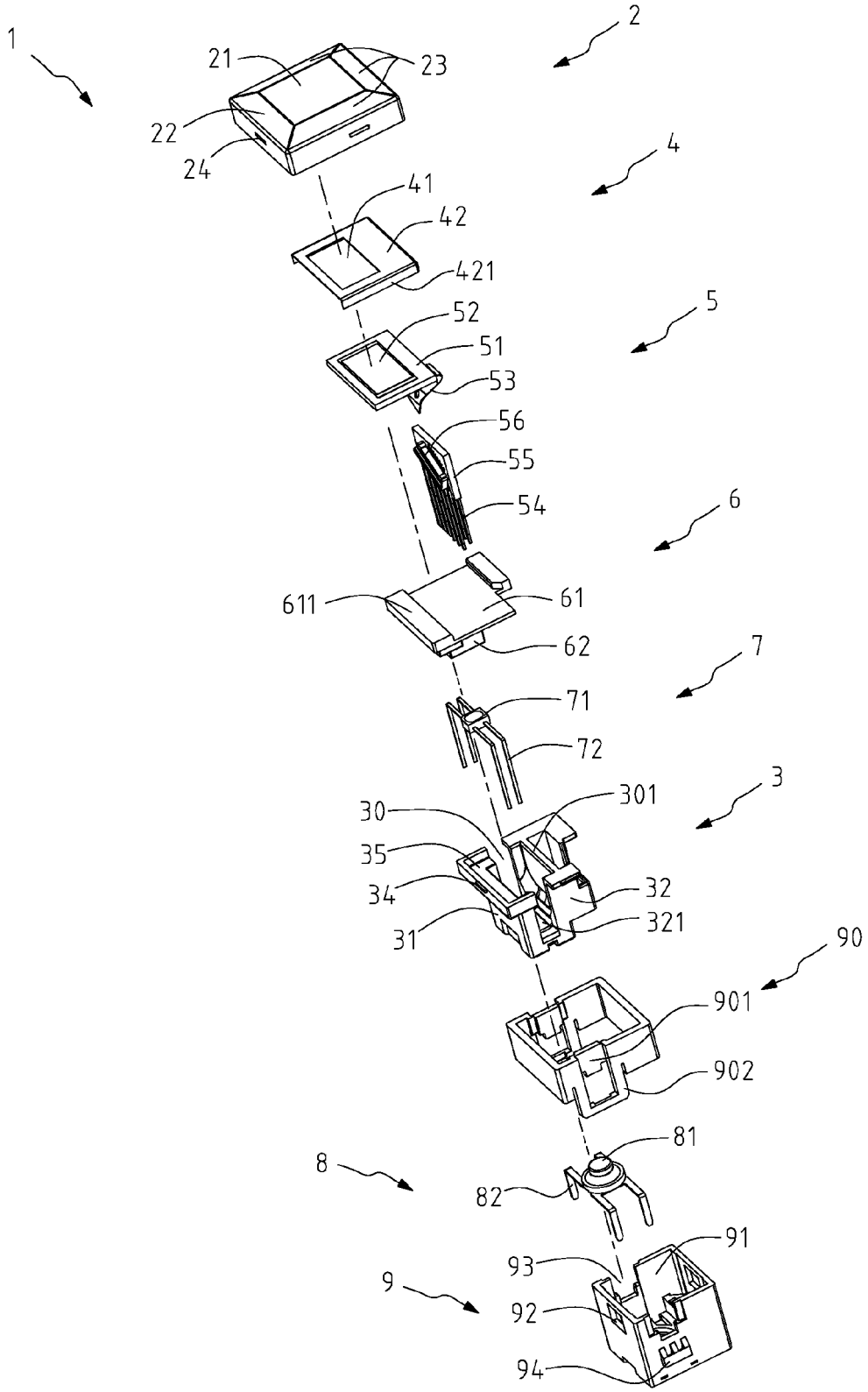
FIG. 3 is a perspective exploded view of FIG. 1.
Figure 4:
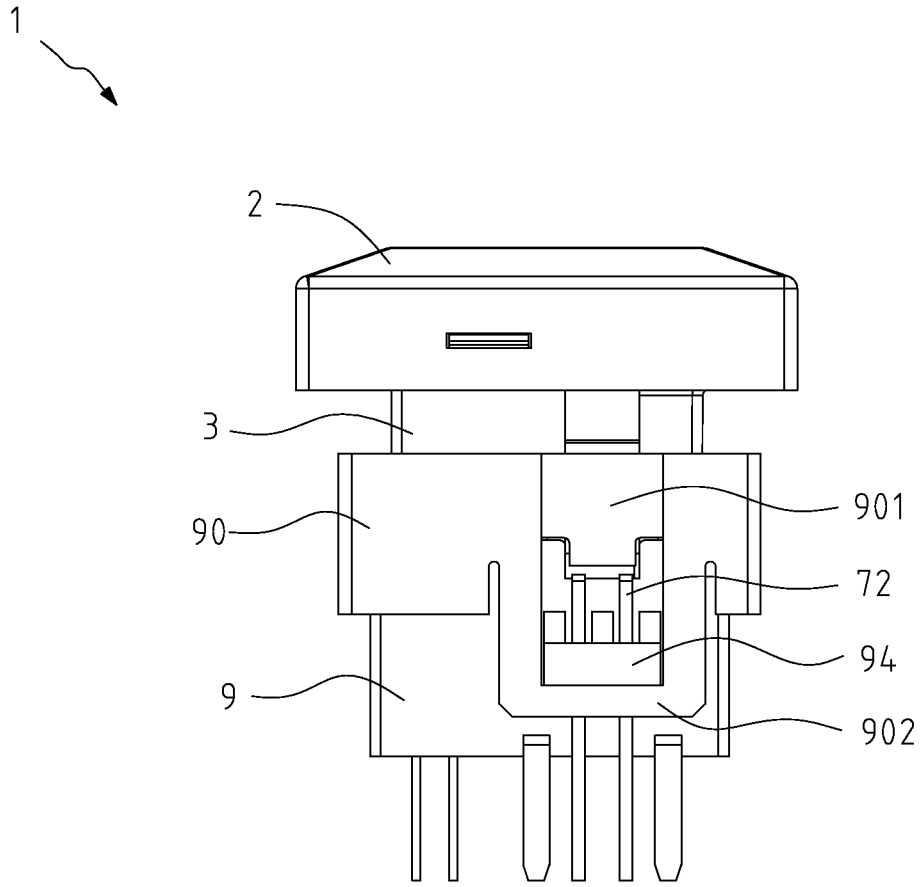
FIG. 4 is a right side elevational view of FIG. 2.

The housing 9 has a storing chamber 91 formed therein which is open upward, and two engaging slots 92 respectively formed on two opposite sides of the housing 9. The engaging rids 311 are slidably engageable with the engaging slots 92 so as to limit a course of travelling of the movable seat 3. The housing 9 further has two grooves 93 respectively formed on two opposite sides thereof and corresponding in position to the guiding slot 321 of the movable seat 3. A channel 94 is provided below each groove 93 on the housing 9, and plural through holes 95 are formed on a bottom of the housing 9 (as shown in FIG. 3).

The display module 5 is disposed between the cap lid 2 and the movable seat 3, and comprises a base portion 51, an organic light emitting diode (OLED) 52, a flexible cable 53, and a connecting board 55 connecting a terminal group 54 and a connector 56. The base portion 51 is disposed on a top of the movable seat 3, and the OLED 52 is disposed on the base portion 51 and is located under and facing the first display portion 21, wherein the connecting board 55 is a circuit board and is perpendicularly disposed with the connector 56 between the partition 301 and one of the interfering walls 31. The one of the interfering walls 31 is recessed to receive a part of the flexible cable 53. The terminal group 54 extends out of the plural through holes 95 of the housing 9 to be connected to a printed circuit board (not shown). One end of the flexible cable 53 is connected to the base portion 51 and another end thereof extends into the accommodating space 30 to connect the connector 56.

The lighting element 7 is fixedly disposed in the accommodating space 30 of the movable seat 3, and comprises a light emitting diode (LED) 71 and a plurality of conductive terminals 72, which are provided on two opposite sides of the LED 71 respectively and extending out of the guiding slots 321 and bending downward to electrically connect the printed circuit board. Portions of the plurality of conductive terminals 72 being bent are located in the grooves 93 of the housing 9 and pass through the channels 94 so as to be effectively positioned therein for avoiding displacement because of shake of the push-type switch 1 in use.

The holding board 6 is disposed on a top and the platforms 35 of the movable seat 3 for holding the base portion 51 of the display module 5 and reinforcing structural structure of the movable seat 3. The holding board 6 has a holding portion 61, a light-permeable portion 611, and a reinforcing pillar 62 formed under the holding portion 61. In this embodiment, the light-permeable portion 611 is located at a side of the holding portion 61 and protrudes upward therefrom. The holding portion 61 is configured to hold the base portion 51 thereon. The light-permeable portion 611 is permeable to light emitted from the lighting element 7. The reinforcing pillar 62 is made of a light-permeable material and is configured to be fittingly embedded into the accommodating space 30 with respect to the positioning walls 32 having the guiding slots 321, the partition 301, and the interfering wall 31. It is noted that the structural structure of the movable seat 3 is reduced because the guiding slots 321 breach the positioning walls 32. As a result, the reinforcing pillar 62 embedded in the accommodating space 30 effectively reinforces structural strength of the movable seat 3, and further prevents the movable seat 3 form being deformed in use.

Figure 2:
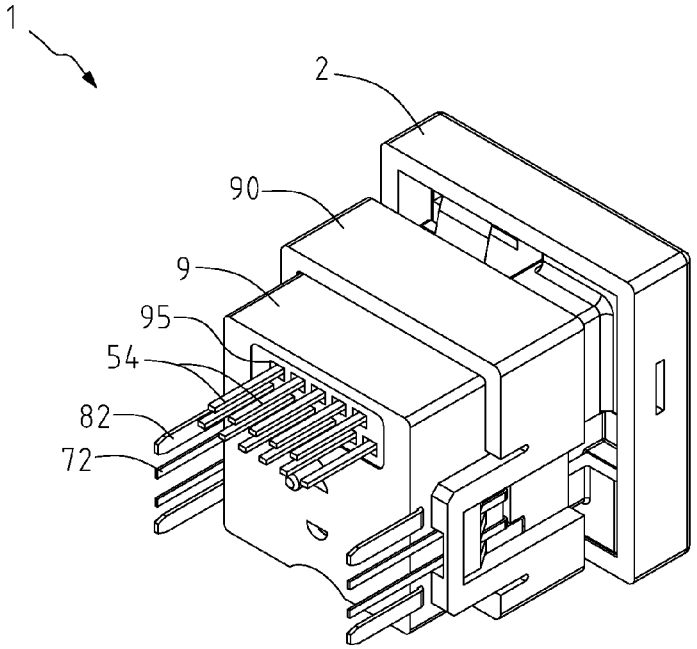
FIG. 2 is a rear, bottom perspective assembly view of the push-type switch of the present invention.

Referring to FIGS. 2 and 3, the shielding board 4 is disposed under the cap lid 2 and above the display module 3. The shielding board 4 has a hollow portion 41 and a shielding portion 42 surrounding the hollow portion 41 for shielding the base portion 51 of the display module 5 and the electromagnetic interference (EMI). The hollow portion 41 is correspondingly fitted to the OLED 52. Additionally, the shielding portion 42 is corresponding to the non-display portion 23 for shielding components inside the housing 9. Particularly note that two opposite sides of the shielding portion 42 further bends to form bending portions 421 respectively for covering corresponding sides of the base portion 51 of the display module 5, so as to position the base portion 51 in a horizontal direction on the holding board 6.

The conducting unit 8 is disposed in the storing chamber 91 of the housing 9 and comprises a conducting element 81 being flexible and a plurality of conducting terminals 82. Each of the conducting terminals 82 has an L shape, and one end of each conducting terminal 82 is secured in the storing chamber 91 and another end thereof extends out of the housing 9 to electrically connect the printed circuited board. The conducting element 81 comprises a contact portion 811 and a flexible portion 812 integrally formed with and under the contact portion 811. The flexible portion 812 radially extends from a bottom of the contact portion 811 to be secured to the housing 9 so as to allow the contact portion 811 to be spaced apart from a bottom of the housing 9 and the plurality of conducting terminals 82. Specifically, when the cap lid 2 is not being depressed, the plurality of conducting terminals 82 are not in contact with the conducting element 81.

The push-type switch 1 further comprises a fixing frame 90 mounted to the housing 9 for reinforcing structural strength of the housing 9. The fixing frame 90 is provided with restraining plates 901 corresponding to the two grooves 93 and located above the plurality of conductive terminals 72 for preventing the plurality of conductive terminals 72 from being displaced in a vertical direction. In addition, the fixing frame 90 further forms fastening bars 902 under the restraining plates 901 for being fastened with the corresponding channels 94 to further secure the fixing frame 90 to the housing 9.

Figure 5:
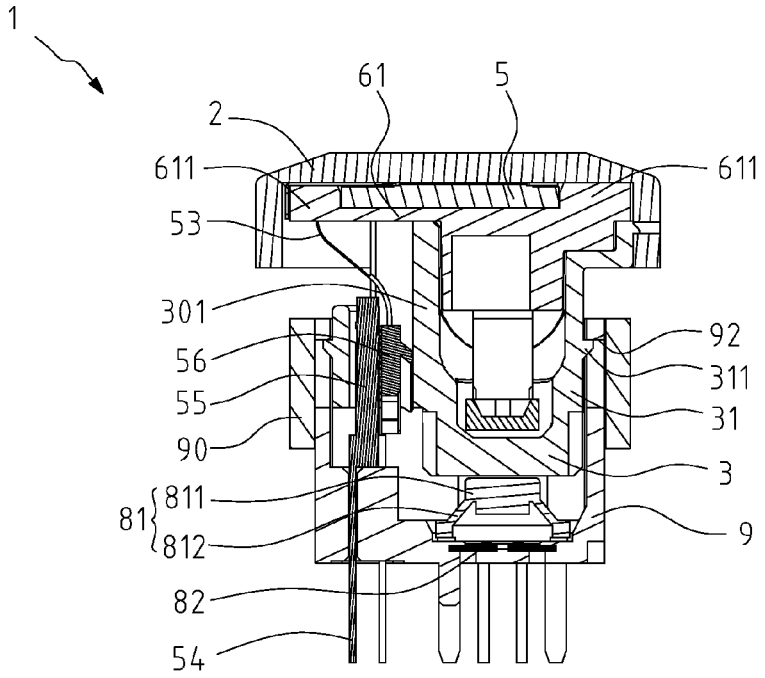
FIG. 5 is a cross-sectional view of the push-type switch of the present invention showing a cap lid is not being pushed.
Figure 6:
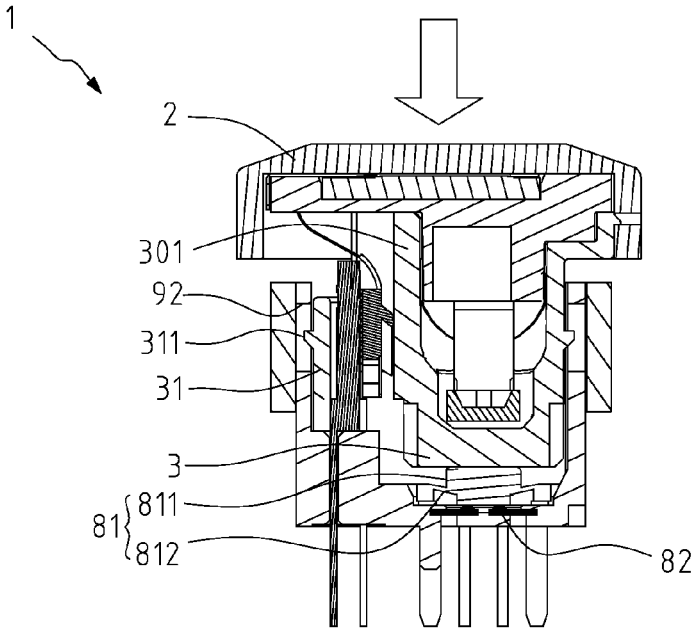
FIG. 6 is the cap lid of FIG. 5 being pushed.

Referring to FIG. 1 in combination with FIGS. 5 and 6, when the push-type switch 1 is in use, the cap lid 2 is being pushed downward to switch on or switch off the push-type switch 1. In a practical application, when the cap lid 2 is not being pushed but in a state of electricity conduction, the lighting element 7 is capable of emitting light of a predetermined color and brightness which is permeable through the light-permeable portion 611 of the holding board 6 to the second display portion 22 of the cap lid 2 so as to indicate that the switch 1 is not being triggered. Alternatively, the lighting element 7 is capable of emitting light of different colors or brightness in accordance with electrical signals transmitted from the printed circuited board to the plurality of conductive terminals 72. In a further embodiment, the lighting element 7 is not emitting light when the cap lid 2 is not being pushed.

Particularly, The OLED 52 of the display module 5 is capable of displaying dynamic images or static images (eg. symbols or patterns) which can be seen from the first display portion 21 of the cap lid 2. When the cap lid 2 is being pushed downward, the movable seat 3 moves concurrently to depress the contact portion 811 of the conducting element 81, whereby the flexible portion 812 is deformed to electrically contact the conducting terminals 82 so as to switch on and off the push-type switch 1 (as shown in FIG. 6); At the same time, the lighting element 7 emits light of a predetermined color and brightness to indicate a state of switch of the switch 1, while the OLED 52 continues displaying the dynamic or static images. In this manner, users can easily and clearly recognize a current state of use of the push-type switch 1 from the lighting of the lighting element 7 and understand functions of an electrical product being applied by the switch 1 from the dynamic and static images of the OLED 52, or recognize what kind of products can be controlled or switched by the push-type switch 1. Alternatively, the display module 5 is also capable of stopping playing images in accordance with the switch state of the push-type switch 1.

Accordingly, the push-type switch 1 of the present invention is to utilize the light emitted by the lighting element 7 and the dynamic or static images displayed by the display module 5, in accordance with electrical signals being received, for simultaneously showing a switching state of the push-type switch 1 and functions of applied products to be controlled by the push-type switch 1, so as to effectively overcome the problem that traditional switches are not capable of indicating a switch state or functions to be controlled on a button thereof. Furthermore, the configuration of the OLED 52 greatly reduces an overall size of the push-type switch 1 because of features of self light-emission and wide viewing angles of the OLED 52. Moreover, the holding board 6 of the present invention effectively improves the structural strength of the movable seat 3 and provides light permeability so as to address the problem that traditional switches are weak in structural strength.

It is understood that the invention may be embodied in other forms within the scope of the claims. Thus the present examples and embodiments are to be considered in all respects as illustrative, and not restrictive, of the invention defined by the claims.

What is claimed is:

1. A push-type switch, comprising:

a movable seat comprising two opposite interfering walls, and two opposite positioning walls for interconnecting the interfering walls, each of the interfering walls having an engaging rib formed on an outer surface thereof, an accommodating space defined by the interfering walls and the positioning walls;

a cap lid covering a top of the movable seat, and comprising a first display portion and a second display portion made of a light permeable material;

a display module disposed between the cap lid and the movable seat and being electrically connected to a printed circuit board, the display module being capable of displaying dynamic images or static images which are being seen from the first display portion of the cap lid;

a lighting element fixedly disposed in the accommodating space of the movable seat and electrically connected to the printed circuit board, the lighting element being capable of emitting light which is permeable to the second display portion of the cap lid for at least indicating a state of switching;

a housing having a storing chamber formed therein which is open upward, and two engaging slots respectively formed on two opposite sides of the housing, the engaging ribs being slidably engageable with the engaging slots so as to limit a course of travelling of the movable seat; and a conducting unit disposed in the storing chamber and comprising a conducting element being flexible and a plurality of conducting terminals, one end of each of the plurality of conducting terminals secured in the storing chamber and another end thereof extending out of the housing to electrically connect the printed circuited board;

wherein when the cap lid is being pushed downward, the movable seat moves concurrently to depress the conducting element, whereby the conducting element being deformed to electrically contact the conducting terminals so as to switch on and off the push-type switch, and the lighting element and the display module being capable of emitting light and displaying images respectively according to the state of switch of the push-type switch and electrical signals transmitted from the printed circuit board to the lighting element and the display module.

2. The push-type switch of claim 1, wherein each of the positioning walls is provided with a guiding slot penetrating a top of the positioning wall, and the lighting element comprising a light emitting diode (LED) and a plurality of conductive terminals connected to two opposite sides of the LED respectively and extending out of the guiding slots to electrically connect the printed circuit board.

3. The push-type switch of claim 2, wherein the housing has two grooves respectively formed on two opposite sides of the housing for receiving the plurality of conductive terminals.

4. The push-type switch of claim 3, further comprising a fixing frame mounted to the housing for reinforcing structural strength of the housing, and the fixing frame is provided with restraining plates corresponding to the two grooves and located above the plurality of conductive terminals for preventing the plurality of conductive terminals from being displaced in a vertical direction.

5. The push-type switch of claim 1, wherein the display module comprises a base portion, at least an organic light emitting diode (OLED), a flexible cable, and a connecting board connecting a terminal group and a connector, the base portion disposed on a top of the movable seat, the at least an OLED disposed on the base portion and located under and facing the first display portion, the connecting board and the connector configured in the accommodating space of the movable seat, where the terminal group extends out of the housing to be connected to the printed circuit board, and one end of the flexible cable is connected to the base portion and another end thereof extends into the accommodating space to connect the connector.

6. The push-type switch of claim 5, further comprising a holding board disposed on the top of the movable seat, the holding board having a holding portion, a light-permeable portion, and a reinforcing pillar formed under the holding portion, the holding portion configured to hold the base portion of the display module, the light-permeable portion being permeable to light emitted from the lighting element, and the reinforcing pillar made of a light-permeable material and embedded into the accommodating space for reinforcing structural strength of the movable seat.

7. The push-type switch of claim 5, wherein the accommodating space of the movable seat is further provided with a partition traversally connecting the positioning walls to divide the accommodating space, and the connecting board and the connector are disposed between the partition and one of the interfering walls.

8. The push-type switch of claim 5, further comprising a shielding board disposed under the cap lid and above the display module, the shielding board having a hollow portion and a shielding portion surrounding the hollow portion for shielding the base portion of the display module, with the hollow portion correspondingly fitted to the OLED.

9. The push-type switch of claim 8, wherein the cap lid further comprises a non-display portion corresponding to the shielding portion of the shielding board.

10. The push-type switch of claim 8, wherein two opposite sides of the shielding portion further bends to form bending portions respectively for covering corresponding sides of the base portion of the display module, so as to position the base portion in a horizontal direction.

* * * * *